US007777701B2

(12) United States Patent
Eom

(10) Patent No.: US 7,777,701 B2
(45) Date of Patent: Aug. 17, 2010

(54) SIGNAL DRIVING METHOD AND APPARATUS FOR A LIGHT EMITTING DISPLAY

(75) Inventor: Ki-Myeong Eom, Suwon-si (KR)

(73) Assignee: Samsung Mobile Display Co., Ltd., Yongin-si (KR)

( * ) Notice: Subject to any disclaimer, the term of this patent is extended or adjusted under 35 U.S.C. 154(b) by 1394 days.

(21) Appl. No.: 11/210,502

(22) Filed: Aug. 23, 2005

(65) Prior Publication Data

US 2006/0044230 A1 Mar. 2, 2006

(30) Foreign Application Priority Data

Aug. 30, 2004 (KR) ..... 10-2004-0068550

(51) Int. Cl.
*G09G 3/32* (2006.01)

(52) U.S. Cl. ..... 345/82

(58) Field of Classification Search ..... 345/76–82, 345/100

See application file for complete search history.

(56) References Cited

U.S. PATENT DOCUMENTS

| | | | | |
|---|---|---|---|---|
| 6,618,031 | B1 * | 9/2003 | Bohn et al. | 345/83 |
| 2003/0227262 | A1 | 12/2003 | Kwon | |
| 2003/0231735 | A1 * | 12/2003 | Moon et al. | 377/64 |
| 2004/0046719 | A1 | 3/2004 | Wang et al. | |
| 2004/0145547 | A1 * | 7/2004 | Oh | 345/76 |

FOREIGN PATENT DOCUMENTS

| | | |
|---|---|---|
| JP | 09-138659 | 5/1997 |
| JP | 2001-060076 | 3/2001 |
| JP | 2002-215093 | 7/2002 |
| JP | 2002-244619 | 8/2002 |
| JP | 2002-268615 | 9/2002 |
| JP | 2003-022058 | 1/2003 |
| JP | 2003-050564 | 2/2003 |
| JP | 2003-122306 | 4/2003 |
| JP | 2003-140619 | 5/2003 |
| JP | 2003-150082 | 5/2003 |
| JP | 2003-150104 | 5/2003 |
| JP | 2003-216100 | 7/2003 |
| JP | 2003-255899 | 9/2003 |
| JP | 2004-029791 | 1/2004 |
| JP | 2004-361935 | 12/2004 |
| WO | WO 98/36407 | 8/1998 |
| WO | WO 01/06484 A1 | 1/2001 |
| WO | WO 01/24153 A1 | 4/2001 |
| WO | WO 03/077231 A2 | 9/2003 |

* cited by examiner

*Primary Examiner*—Chanh Nguyen
*Assistant Examiner*—Jonathan Blancha
(74) *Attorney, Agent, or Firm*—Christie, Parker & Hale, LLP

(57) ABSTRACT

A light emitting display having a display area including data lines, selection scan lines, first and second emission control lines, and pixels; a selection signal generator sequentially outputting selection signals having a selection pulse; and an emission control signal generator generating a first control signal, the first control signal sequentially outputting a first emission control signal having an emission control pulse and a shifted first emission control pulse while shifting the first emission control signal by the first length of time, and sequentially outputting a second emission control signal having the emission control pulse and a shifted second emission control pulse while shifting the second emission control signal by the first length of time.

23 Claims, 14 Drawing Sheets

SIGNAL DRIVING METHOD AND APPARATUS FOR A LIGHT EMITTING DISPLAY

CROSS REFERENCE TO RELATED APPLICATION

This application claims priority to and the benefit of Korean Patent Application No. 10-2004-0068550 filed on Aug. 30, 2004 in the Korean Intellectual Property Office, the entire content of which is incorporated herein by reference.

BACKGROUND OF THE INVENTION

1. Field of the Invention

The present invention relates to a light emitting display, and more particularly to a light emitting display using electroluminescence of organic materials.

2. Description of the Related Art

In general, an organic light emitting diode display electrically excites phosphorus organic components and generates an image by voltage-programming or current-programming an n×m matrix of organic light emitting cells. These organic light emitting cells have features similar to a diode and are called organic light emitting diodes (OLEDs).

The OLED includes an anode, an organic thin film, and a cathode layer. The organic thin film layer has a multi-layered structure including an emission layer (EML), an electron transport layer (ETL), and a hole transport layer (HTL) in order to balance electrons and holes and to enhance efficiency of light emission. Further, the organic thin film separately includes an electron injection layer (EIL) and a hole injection layer (HIL).

Methods of driving the organic light emitting cells having the foregoing configuration include a passive matrix method and an active matrix method. In the passive matrix method, an anode and a cathode are formed crossing each other and a line is selected to drive the organic light emitting cells. The active matrix method, on the other hand, employs a MOSFET or a thin film transistor (TFT). In the active matrix method, a pixel electrode of indium tin oxide (ITO) is coupled to the TFT, and a voltage that is maintained by a capacitor coupled to a gate of the TFT drives the light emitting cell. Depending on the type of signal transmission used for distinctively programming the voltage applied to the capacitor, the active matrix method is classified into a voltage programming method and a current programming method.

A pixel circuit of an organic light emitting display employing the active matrix method is described below. FIG. 1 shows a pixel circuit for a pixel located on a first row and a first column among the n×m matrix of pixels. A pixel 10 has three sub-pixels 10*r*, 10*g*, 10*b* which use OLEDs. Depending on the color of the light emitted by these diodes, they are labeled OLEDr, OLEDg, and OLEDb emitting lights of red R, green G, and blue B, respectively. The sub-pixels are arranged in a strip format with each of pixels coupled to a separate data line D1*r*, D1*g*, D1*b* and all of the pixels coupled to one common scan line S1.

The red sub-pixel 10*r*, that generates red light, includes a driving transistor M1*r*, a switching transistor M2*r*, and a capacitor C1*r* to drive the OLEDr. Similarly, a green sub-pixel 10*g*, that generates green light, includes a driving transistor M1*g*, a switching transistor M2*g*, and a capacitor C1*g*, and a blue sub-pixel 10*b*, that generates blue light, includes a driving transistor M1*b*, a switching transistor M2*b*, and a capacitor C1*b*.

All of the red, green, and blue sub-pixels 10*r*, 10*g*, 10*b* operate similarly. Therefore, the operation of the red sub-pixel 10*r* will be described as a representative example. The driving transistor M1*r* is coupled between a power source of voltage VDD and an anode of the OLEDr, and sends a current to the OLEDr for light emission. A cathode of the OLEDr is coupled to a voltage VSS which is lower than the power source voltage VDD. The amount of current of the driving transistor M1*r* is controlled by a data voltage applied through the switching transistor M2*r*. The capacitor C1*r* is coupled between a source and a gate of the driving transistor M1*r* and maintains a voltage applied between the source and the gate of the driving transistor M1*r* for a predetermined period of time. A scan line S1 transmitting an on/off selection signal is coupled to a gate of the switching transistor M2*r*, and a data line D1*r* transmitting a data voltage corresponding to the red sub-pixel 10*r* is coupled to a source of the switching transistor M2*r*.

When the switching transistor M2*r* is turned on in response to the selection signal applied to the gate of the switching transistor M2*r*, a data voltage $V_{DATA}$ is applied to the gate of the driving transistor M1*r* through the data line D1*r*. Consequently, a current $I_{OLED}$ corresponding to a voltage $V_{GS}$ charged between the gate and source of the driving transistor M1*r* by the capacitor C1*r* flows through the driving transistor M1*r*, and the OLEDr emits light corresponding to the current $I_{OLED}$. The current $I_{OLED}$ flowing to the OLEDr is given by Equation 1.

$$I_{OLED} = \frac{\beta}{2}(V_{GS} - V_{TH})^2 = \frac{\beta}{2}(V_{DD} - V_{DATA} - |V_{TH}|)^2 \quad \text{[Equation 1]}$$

where, β is a constant number representing the gain of the transistor M1*r* and $V_{TH}$ is the threshold voltage of this transistor.

As seen in Equation 1, the current $I_{OLED}$ applied to the OLEDr, that is proportional to the data voltage $V_{DATA}$, causes the OLEDr to emit light with luminance corresponding to the current $I_{OLED}$. The applied data voltage $V_{DATA}$ is maintained within a predetermined range in order to express brightness according to predetermined scales.

As described above, in the organic light emitting display, a pixel 10 has three sub-pixels of red, green, and blue 10*r*, 10*g*, 10*b* and each of the sub-pixels has a driving transistor M1*r*, M1*g*, M1*b*, a switching transistor M2*r*, M2*g*, M2*b*, and a capacitor C1*r*, C1*g*, C1*b* to drive a corresponding OLEDr, OLEDg, OLEDb. Further, each of the sub-pixels 10*r*, 10*g*, 10*b* includes a data line D1*r*, D1*g*, D1*b* to transmit a data signal and a power line to transmit a voltage VDD. Many wires are required to drive a pixel 10, causing difficulty in arranging the wires within a pixel area and decreasing an opening ratio available for actual display. Thus, development of a pixel circuit requiring less wiring and fewer elements for driving a pixel is desirable.

SUMMARY OF THE INVENTION

Accordingly, the present invention provides a light emitting display having a plurality of OLEDs commonly coupled to a pixel driver to reduce the total number of wires and elements required and to improve the opening ratio and yield by better utilizing the panel space.

In addition, the present invention provides a signal driver sequentially producing output signals to enable a plurality of OLEDs to emit light after a pixel driver is stably initialized, as well as a light emitting display including this signal driver.

The features of the present invention are also achieved by providing a light emitting display including a display area, a selection signal generator, and an emission control signal generator. The pixel areas include a plurality of data lines, a plurality of selection scan lines, a plurality of first and second emission control lines, and a plurality of pixels. The data lines transmit data signals for displaying an image. The selection scan lines transmit selection signals. The first and second emission control lines respectively transmit first and second emission control signals. The pixels are coupled together by the data lines and the selection scan lines, and each have first and second light emitting elements. The selection signal generator sequentially outputs selection signals having a selection pulse while shifting the selection signals by a first length of time in each of a first field and a second field. The emission control signal generator generates a first control signal from the selection pulse of the selection signal in each of the first and second fields, the first control signal having a control pulse of which the width is smaller than the width of the selection pulse. The emission control signal generator sequentially outputs a first emission control signal having an emission control pulse corresponding to the control pulse and a shifted emission control pulse after a predetermined time period is passed in the emission control pulse while shifting the first emission control signal by the first length of time. Further, the emission control signal generator sequentially outputs a second emission control signal having the emission control pulse and a fifth pulse after the predetermined time period is passed in the emission control pulse for the second field while shifting the second emission control signal by the first length of time.

A data signal corresponding to the first light emitting element is transmitted to the data lines while the selection pulse of the selection signal is applied to the first field, and a data signal corresponding to the second light emitting element is transmitted to the data lines while the selection pulse of the selection signal is applied to the second field.

The selection signal generator includes a first shift register sequentially generating a first shift register signal having a first shift register pulse while shifting the first shift register signal by the first length of time, and a first circuit that outputs a selection signal having the selection pulse while the first shift register signal and a signal which is the first shift register signal shifted by the first length of time are in a first shift register pulse period.

The first circuit receives an enable signal, and outputs a selection signal having the selection pulse while the signal which is the first shift register signal shifted by the first length of time and the enable signal are in the first shift register pulse period.

The emission control signal generator includes a second shift register, a second circuit, and a third circuit. The second shift register sequentially generates a second shift register signal alternately having a second shift register pulse and an eighth pulse having an inverted second shift register pulse while shifting the second shift register signal by the first length of time. The second circuit partially cuts the selection pulse of the selection signal and outputs the cut selection pulse as the control pulse of the first control signal. The logic circuit generates the first and second emission control signals using the control pulse of the first control signal, the second shift register signal, and the shifted second shift register signal, and outputs the first and second emission control signals.

The second circuit outputs a control pulse for a period in which a first clock signal and the selection signal have a level corresponding to the selection pulse, the first clock signal having a period twice longer than the first length of time.

The first clock signal is a second clock signal input to the second shift register and shifted by a predetermined time period.

The logic circuit outputs the shifted emission control pulse for a period in which the second shift register signal and a signal which is the second shift register signal shifted by the first length of time have the second shift register pulse and generates the first emission control signal from the shifted emission control pulse and the control pulse of the first field, and outputs the fifth pulse for a period in which the second shift register signal and a signal which is the second shift register signal shifted by the first length of time have the eighth pulse and generates the second emission control signal from the fifth pulse and the emission control pulse of the second field.

The period in which the second shift register pulse of the second shift register signal is applied corresponds to the first field.

The emission control pulses of the first and second emission control signals are applied while a selection pulse of a signal is applied, the signal being the selection signal before it is shifted by the first length of time.

Each of the plurality of pixels includes a first transistor, a first capacitor, a second transistor, a third transistor, a second capacitor, a fourth transistor, first and second light emitting elements, and first and second switches. The first transistor is turned on in response to the first level of the first selection signal and transmits the data signal. The first capacitor stores a voltage corresponding to the data signal transmitted by the first transistor. The second transistor is coupled in parallel with the first capacitor in response to a first level of the second selection signal. The third transistor outputs a current corresponding to the voltage stored in the first capacitor. The second capacitor stores a voltage corresponding to a threshold voltage of the third transistor. The fourth transistor diode-connects the third transistor in response to the first level of the second selections signal. The first and second light emitting elements emit light of first and second colors in response to the current. The first and second switches are turned on in response to the second levels of the first and second emission control signals and selectively transmit the current to the first and second light emitting elements.

It is another aspect of the present invention to provide a driving method of a light emitting display including a plurality of pixels driven by a first selection signal and a control signal. In the driving method, a) the first selection signal having a selection pulse of a first level is applied; and b) the control signal having a control pulse of the first level while the first selection signal is partially in the first level and an emission control pulse of the first level while the first selection signal is in an inverted first level is applied.

In a), the second and fourth transistors are turned on in response to the first level of the first selection signal.

In b), one of the first and second switches is turned on in response to the first level of the control signal.

It is another aspect of the present invention to provide a signal driving apparatus generating a sequentially shifted signal and outputting the signal, the signal driving apparatus including a first shift register, a first circuit, a second shift register, a second circuit, and a logic circuit. The first shift register sequentially generates a first control signal having a selection pulse of a first level using a first clock signal and a first start signal while shifting the first control signal by a first length of time. The first circuit sequentially generates a selection signal having a control pulse of a second level using the first control signal and a signal which is the first control signal shifted by the first length of time. The second shift register sequentially generates a first shift register signal having an emission control pulse of the first level using the first clock signal and a second clock signal while shifting the first shift register signal by the first length of time. The second circuit generates a third signal having a fourth pulse in the first level using the selection signal and the second clock signal. The third circuit generates a first control signal using the first shift register signal, a signal which is the first shift register signal shifted by the first length of time, and the third signal.

The first circuit generates a selection signal having a control pulse of a second level while the first control signal and the signal which is the first control signal shifted by the first length of time are in the first level.

The second clock signal corresponds to the first clock signal shifted by a predetermined time period, and the second circuit generates a third signal having a fourth pulse while the selection signal and the first shift register signal are in the same level.

The third circuit generates a fourth signal having a first level while the first shift register signal and the third signal are in the first level, generates a fifth signal having the first level while the first shift register signal and the signal which is the first shift register signal shifted by the first length of time are in the first level, and generates a first control signal having the first level while the fourth and fifth signals are in the second level.

The signal driving apparatus further includes a fourth circuit generating a second control signal using the first shift register signal, the signal which is the first shift register signal shifted by the first length of time, and the third signal.

The fourth circuit generates a sixth signal having the first level and a seventh signal having the first level while the first shift register signal and the signal which is the first shift register signal shifted by the first length of time are in the first level, and generates a first control signal having the first level while the sixth and seventh signals are in the second level.

The first level is a high level signal and the second level is a low level signal.

It is another aspect of the present invention to provide a driving method of a light emitting display including a plurality of pixels driven by a first selection signal and a control signal, the respective pixels including a first transistor, a first capacitor, a second transistor, a third transistor, a second capacitor, a fourth transistor, first and second light emitting elements, and first and second switches. In the driving method: a) a first selection signal having a selection pulse of a first level is applied; and b) the control signal having an emission control pulse of the first level while the first selection signal has a control pulse of the first level while the first selection signal is partially in the first level and the first selection signal has an inverted first level is applied. The first transistor is turned on in response to the first level of the first selection signal and transmits the data signal. The first capacitor stores a voltage corresponding to the data signal transmitted by the first transistor. The second transistor is coupled in parallel with the first capacitor in response to a first level of the second selection signal. The third transistor outputs a current corresponding to the voltage stored in the first capacitor. The second capacitor stores a voltage corresponding to a threshold voltage of the third transistor. The fourth transistor diode-connects the third transistor in response to the first level of the second selection signal. The first and second light emitting elements emit light of first and second colors in response to the current. The first and second switches are turned on in response to the second levels of the first and second emission control signals and selectively transmit the current to the first and second light emitting elements.

DETAILED DESCRIPTION

Throughout the specification, the terminology "present scan line" refers to a scan line which is going to transmit a present selection signal, and "previous scan line" refers to a scan line that has transmitted a selection signal before transmission of the present selection signal. Further, a pixel that emits light in accordance with the selection signal of the present scan line will be referred to as a "present pixel", and a pixel that emits light in accordance with the selection signal of the previous scan line will be referred to as a "previous pixel."

Figure 1:
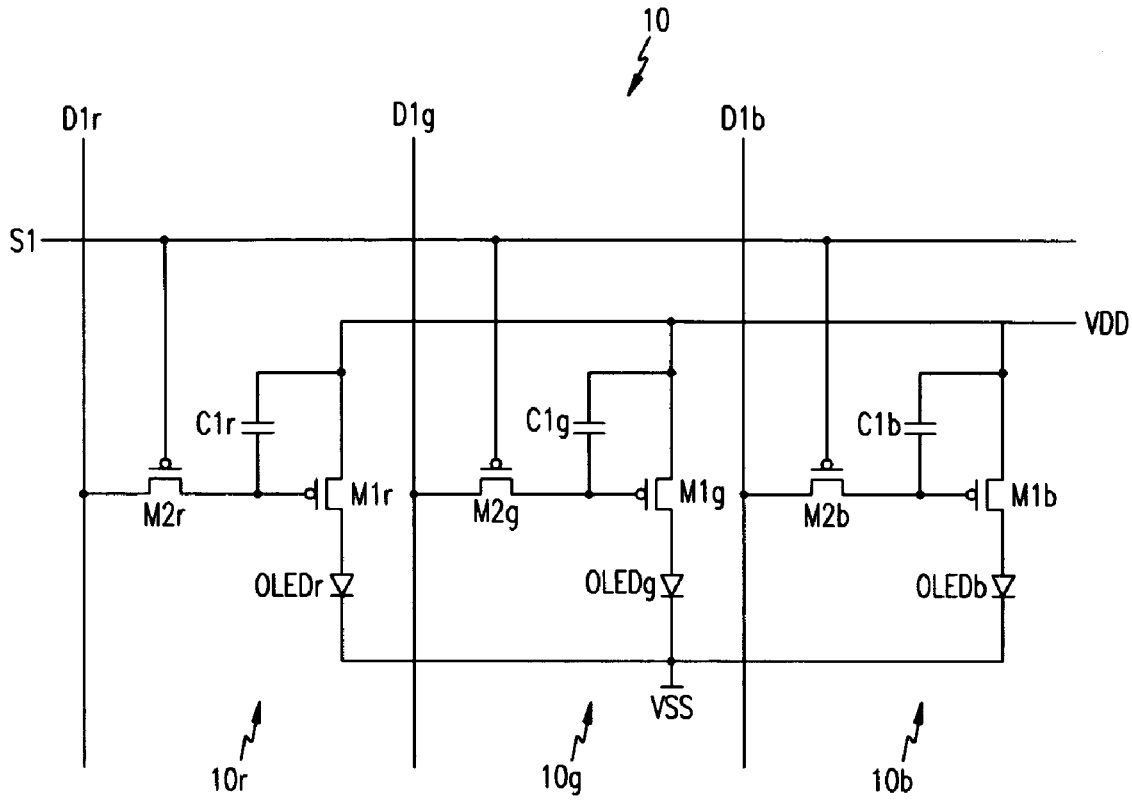
FIG.1(Prior Art)
FIG. 1 shows a pixel circuit in a conventional organic light emitting display panel.
Figure 2:
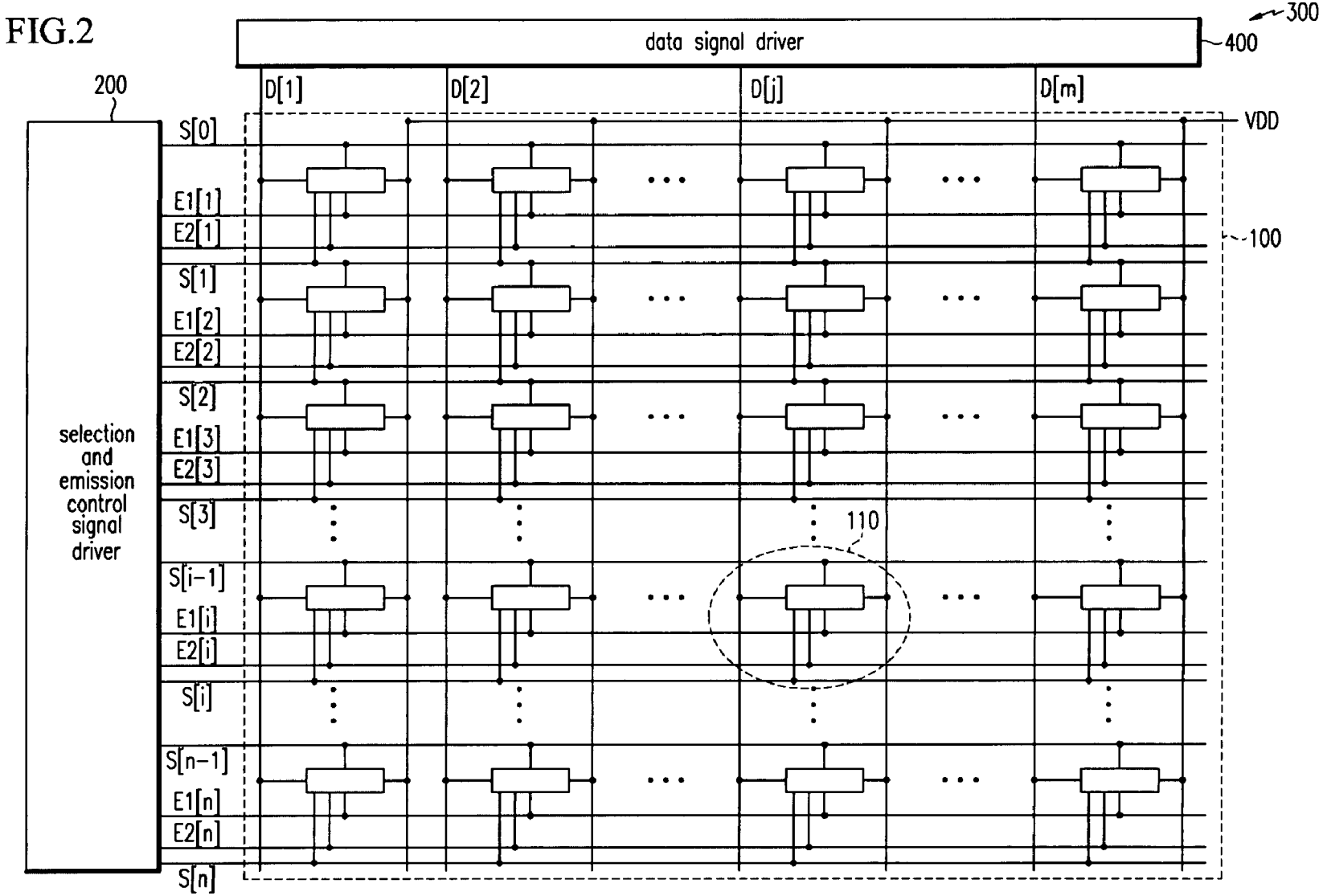
FIG. 2 shows a configuration of an organic light emitting display according to embodiments of the present invention.

FIG. 2 shows a configuration of an organic light emitting display 300 according to embodiments of the present invention. The organic light emitting display 300 includes a display panel 100, a selection and emission control signal driver 200, and a data signal driver 400. The display panel 100 includes a plurality of selection scan lines S[i] arranged in rows, a plurality of emission control lines E1[*i*], E2[*i*] also arranged in rows, a plurality of data lines D[j] arranged in columns, a plurality of power lines applying a voltage VDD, and a plurality of pixels 110. The index 'i' represents a random natural number between 1 and n, and 'j' represents a random natural number between 1 and m. The scan lines S[i] span from S[0] through S[n], while the emission control lines E1[*i*], E2[*i*] span from E1[1] through E1[*n*] and E2[1] through respectively. The data lines D[j] span from D[1] through D[m]. So, only for the case of the scan lines S[i], the index i corresponds to an integer number between 0 and n.

A pixel 110 is formed in a pixel area defined by two adjacent selection scan lines S[i−1] and S[i], and two adjacent data lines D[j] and D[j+1], and includes two light emitting elements OLED1, OLED2 among the red, green, and blue OLEDs. The pixel 110 is driven by signals transmitted from a present selection scan line S[i], a previous selection scan line S[i−1], the emission control lines E1[*i*], E2[*i*], and the data line D[j]. The two light emitting elements OLED1, OLED2 of the pixel 110 emit light during a time interval that is time-divided according to a data signal applied through the data line D[j]. The emission control signals applied to each of the emission control lines E1[*i*], E2[*i*] are controlled to enable the two light emitting elements OLED1, OLED2 to emit light during the time-divided interval.

The selection and emission control signal driver 200 sequentially transmits a selection signal to the selection scan lines S[1] to S[n] and sequentially transmits an emission control signal to the emission control lines E1[*i*], E2[*i*] to control light emission of the two light emitting elements OLED1, OLED2. The data signal driver 400 applies a data signal corresponding to a selected pixel to the data lines D[1] to D[m] when the selection signal is sequentially applied to the data signal driver 400.

Further, the selection and emission control signal driver 200 and the data signal driver 400 are both coupled to a substrate where the display panel 100 is formed. Alternatively, the selection and emission control signal driver 200 and the data signal driver 400 can be replaced with a driving circuit formed on a glass substrate of the display panel 100, where the driving circuit may be layered in a manner such that a scan line, a data line, and a transistor lie in different layers. In another variation, the selection and emission control signal driver 200 and the data signal driver 400 can be attached on the glass substrate as a chip including a tape carrier package (TCP), a flexible printed circuit (FPC), or a tape automatic bonding (TAB).

Figure 4:
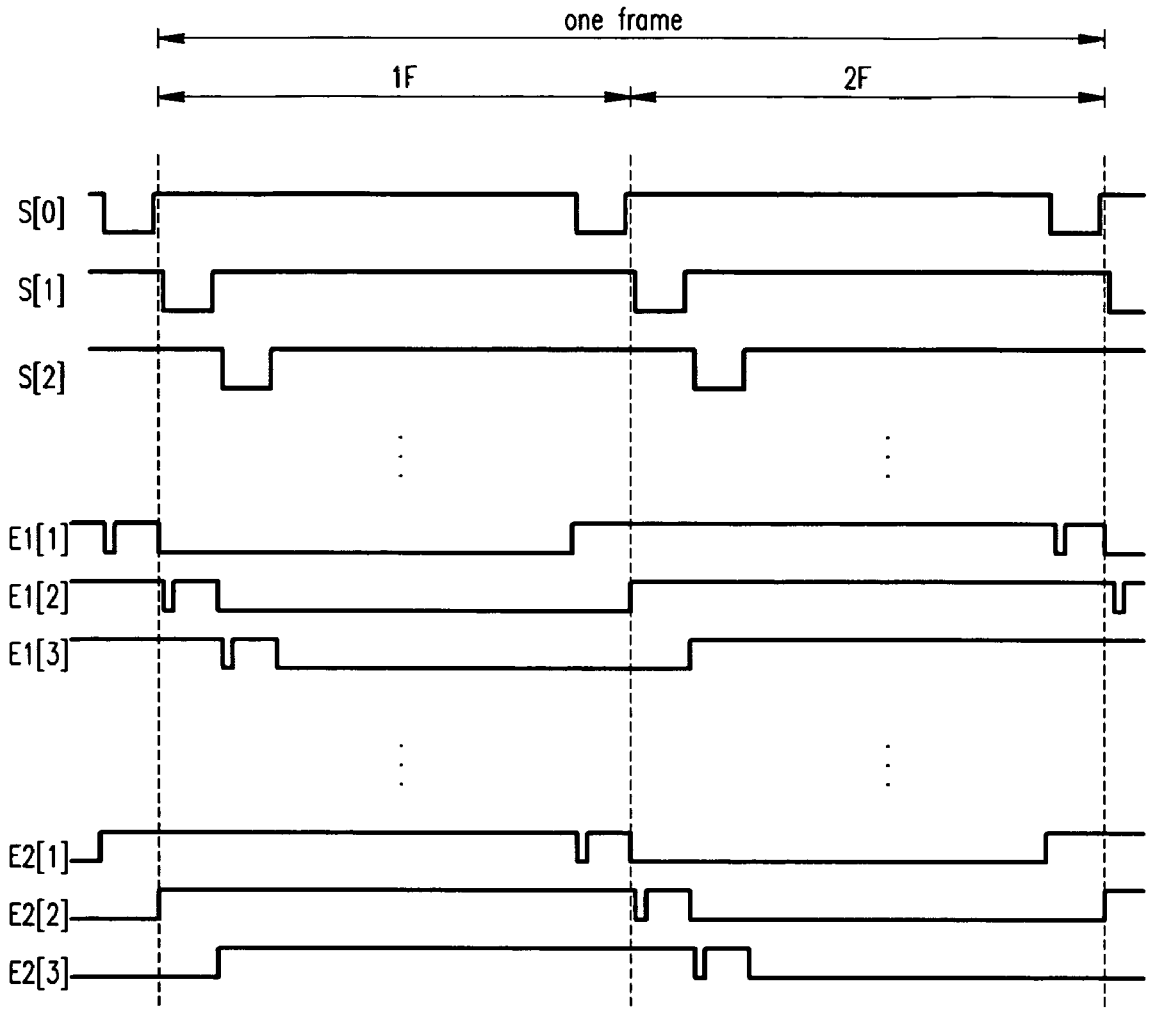
FIG. 4 shows signal timing of an organic light emitting display according to embodiments of the present invention.

According to the embodiments of the present invention, one frame is time-divided into two fields (see FIG. 4). The two fields emit light according to light emission by the two light emitting elements OLED1, OLED2 that are selected from the red, green, and blue OLEDs based on the data written in the two fields. The selection and emission control signal driver 200 sequentially transmits the selection signal to each field through the selection scan lines S[i], and sequentially transmits the emission control signal to corresponding emission control lines E1[*i*], E2[*i*] to control the two light emitting elements OLED1, OLED2 included in one pixel 110 to emit light during one frame scan. The data signal driver 400 applies data signals of red, green, and blue (RGB) to the corresponding data line D[j] in each field.

Figure 3:
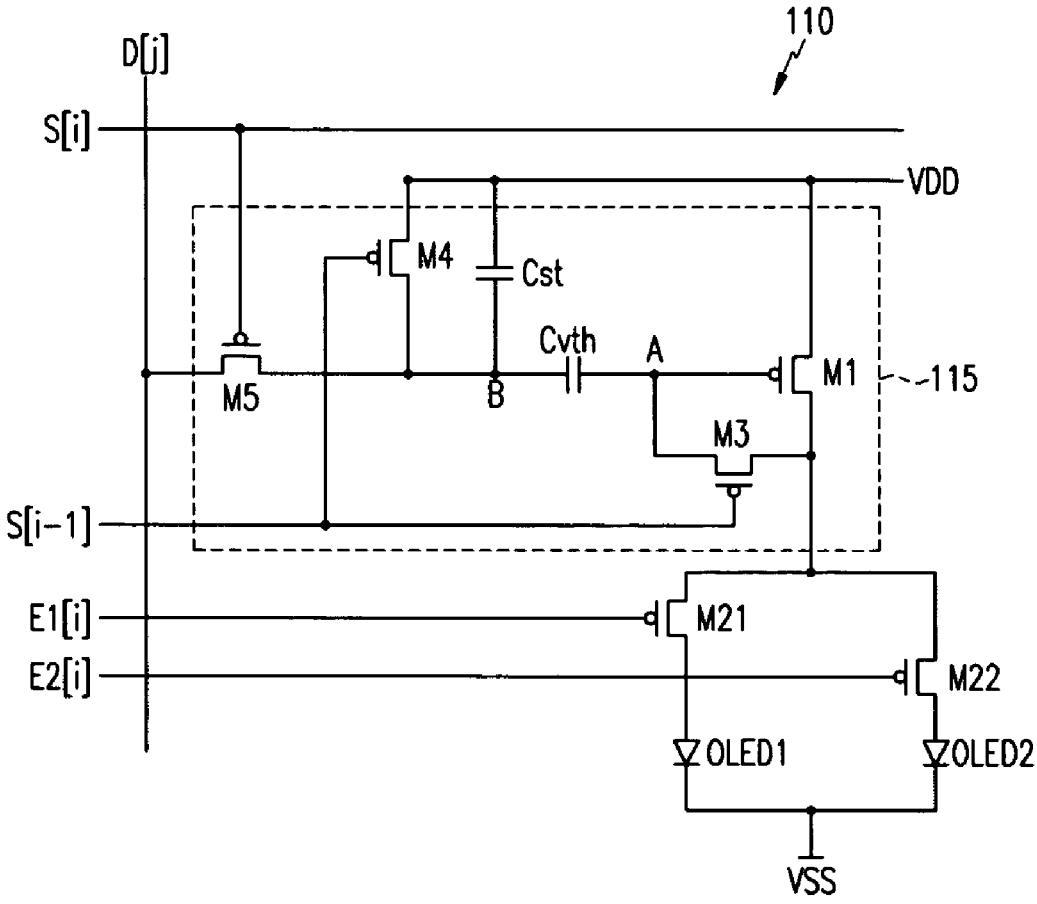
FIG. 3 shows a circuit diagram of a pixel in an organic light emitting display according to embodiments of the present invention.

FIG. 3 is a pixel diagram illustrating a pixel 110 of an organic light emitting display 300 according to the embodiments of the present invention. This figure exemplarily depicts a pixel 110 formed in a pixel area defined by the ith scan line S[i] and the jth data line D[j] where i and j are integers with 1<i<n and 1<j<m. The labels assigned to the emission control signals applied to the emission control lines E1[*i*], E2[*i*] are also E1[*i*], E2[*i*], and the label of a selection signal applied to the selection line S[i] is also S[i] for ease of description.

As shown in FIG. 3, the pixel circuit 110 includes a pixel driver 115, two light emitting elements OLED1, OLED2, and two transistors M21, M22 respectively controlling the two light emitting elements OLED1, OLED2 and selectively causing them to emit light. The two light emitting elements OLED1, OLED2 included in the pixel 110 are selected from among a red, a green, and a blue light emitting element, OLEDr, OLEDg, OLEDb. The transistors M1, M21, M22, M3, M4, M5 included in the pixel 110 are exemplarily depicted as P-channel transistors.

The pixel driver 115 is coupled to the selection scan line S[j] and the data line D[j], and generates a current to be applied to the Light emitting elements OLED1, OLED2 corresponding to a data signal transmitted through the data line D[j]. According to the embodiments of the present invention, the pixel driver 115 includes transistors M1, M3, M4, M5 and first and second capacitors Cvth, Cst. However, the numbers of transistors and capacitors are not limited to those shown in the figure and as long as the current to be applied to the Light emitting elements OLED1, OLED2 can be generated from the circuit, other appropriate arrangements and numbers may be used.

A gate of the transistor M5 is coupled to a present selection scan line S[i] and a source of the transistor M5 is coupled to a data line D[j]. The transistor M5 transmits a data voltage applied through the data line D[j] to a node B of the first capacitor Cvth in response to a selection signal from the selection scan line S[i]. The transistor M4 directly couples the node B of the first capacitor Cvth to a power line of voltage VDD in response to a selection signal from a previous selection scan line S[i−1]. The transistor M1 is diode-connected by the transistor M3 in response to the selection signal from the previous selection scan line S[i−1]. The transistor M1 is a driving transistor to drive the two light emitting elements OLED1, OLED2. A gate of the transistor M1 is coupled to a node A of the first capacitor Cvth and a source of the transistor M1 is coupled to the power VDD. A current to be applied to the two light emitting elements OLED1, OLED2 is controlled by a voltage applied to the gate of the driving transistor M1.

Further, the second capacitor Cst has a first electrode coupled to the power line of voltage VDD and a second electrode coupled to a drain electrode (node B) of the transistor M4. A first electrode of the first capacitor Cvth is coupled to the second electrode of the second capacitor Cst at node B, and thus, the two capacitors Cvth, Cst are coupled in series. A second electrode of the first capacitor Cvth is coupled to the gate (node A) of the driving transistor M1.

Sources of the two transistors M21, M22 controlling the two light emitting elements OLED1, OLED2 are both coupled to a drain of the driving transistor M1. Each of the emission control lines E1[*i*], E2[*i*] is coupled to gates of the two controlling transistor M21, M22. Anodes of the two light emitting elements OLED1, OLED2 are coupled to drains of the two controlling transistors M21, M22, and a voltage VSS applied to cathodes of the two light emitting elements OLED1, OLED2 is lower than the voltage VDD. A negative voltage or a ground voltage may replace the voltage VSS.

Figure 5:
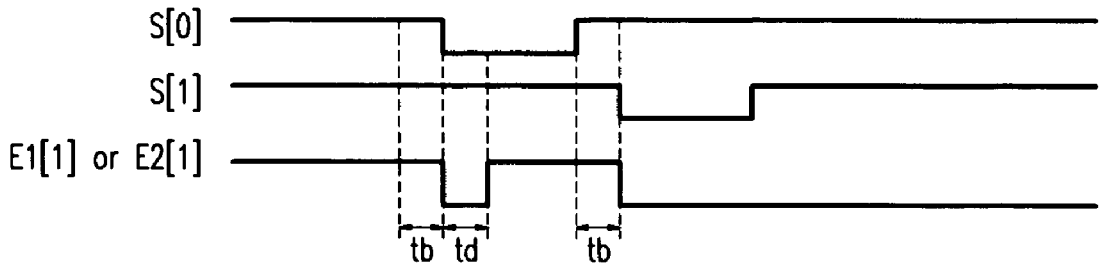
FIG. 5 shows an enlarged view for signal timing of selection signals S[0] and S[1] and emission control signal E[1].

FIG. 4 and FIG. 5 show a driving method of an organic light emitting display according to an embodiment of the present invention. FIG. 4 depicts signal timing of the organic light emitting display, and FIG. 5 depicts signal timing of selection signals S[0] and S[1] and emission control signal E1[1] or E2[1] in an enlarged view.

As discussed above, in order to simplify the following description, a selection signal applied to a selection scan line S[i] is also labeled as S[i] where i is an integer and 0<i<n. Similarly, emission control signals applied to emission control lines E1[*i*], E2[*i*] are also labeled E1[*i*], E2[*i*] where i is an integer and 1<i<n. In addition, a data voltage applied to the jth data line D[j] is labeled as D[j] where m is an integer and 1<j<m.

As shown in FIG. 4, in the organic light emitting display according to the embodiment of the present invention, one frame is divided into a first field 1F and a second field 2F; Selection signals S[0] to S[n] are sequentially applied during the two fields 1F, 2F. The two Light emitting elements OLED1, OLED2 share the driving circuit 115 and each emit light for one field period. Each field 1F, 2F is individually defined by rows, and the two fields 1F, 2F in FIG. 4 are defined by the first scan line S[1] of the first row.

During the first field 1F, the transistor M3 and the transistor M4 are turned on when a low-level selection signal is applied to a previous selection scan line S[0]. The transistor M1 becomes diode-connected as the transistor M3 is turned on. Thus, a voltage difference between the gate and source of the transistor M1 varies until it becomes a threshold voltage Vth of the transistor M1. At this moment, the source of the transistor M1 is coupled to the power VDD, and therefore a voltage applied to the gate of the transistor M1, that is the node A of the capacitor Cvth, becomes a sum of the voltage VDD and the threshold voltage Vth. In addition, a voltage $V_{cvth\ is}$ charged in the capacitor Cvth when the transistor M4 is turned on and the voltage VDD is applied to the node B of the capacitor Cvth. This voltage is given by Equation 2.

$$V_{Cvth}=V_{CvthA}-V_{CvthB}=(VDD+Vth)-VDD=Vth \quad \text{[Equation 2]}$$

where $V_{cvth}$ represents a voltage charged in the capacitor Cvth, $V_{cvthA}$ represents a voltage applied to the node A of the capacitor Cvth, and $V_{cvthB}$ represents a voltage applied to the node B of the capacitor Cvth.

A low-level emission control signal E1[1] is applied to the transistor M21 for a predetermined period of time td while the low-level selection scan signal S[0] is being applied to transistors M3, M4. As a result of the signals applied, the transistor M3 is turned on for the predetermined period of time td diode-connecting the transistor M1. During this same period td, the low-level emission control signal E1[1] is applied to the gate of the transistor M21 and the transistor M21 is turned on. As the transistors M3 and M21 are turned on, a current initialization path is formed from the gate of the transistor M1, that is the node A of the capacitor Cvth to the cathode VSS of a first of the two light emitting elements OLED1 through the transistor M3. The node A of the capacitor Cvth is initialized to VSS-Vth. After the predetermined period of time td is passed, the emission control signal E1[1] becomes high and the transistor M21 is turned off, thereby preventing a current from the transistor M1 from flowing to the first light emitting element OLED1.

In the case that the initialization of the capacitor Cvth varies from pixel to pixel, the voltage Vgs of the transistor M1 in each pixel changes and thus the current $I_{OLED}$ output from the transistor M1 may vary. However, the predetermined period of time td, also called the initialization period, and a light emission period during which the low-level emission control signal is applied to the emission control line E1[1] and the current $I_{OLED}$ is supplied to a second of the two light emitting elements OLED2 are separate. Separating the initialization period td, and the light emission period, causes the capacitor Cvth to be uniformly and stably initialized according to the embodiment of the present invention.

A high-level previous selection signal S[1] and a high-level present selection signal S[2] are applied for a predetermined blanking period tb. By providing such a blanking period tb, a functional error occurring due to transmission delay of the selection scan signal S[i] can be prevented.

After the blanking period tb has passed, a low-level selection signal is applied to a present selection scan line S[2]. The transistor M5 is turned on by the low-level present selection signal S[2] and a data voltage Vdata applied through a data line D1 is applied to the node B of the capacitor Cvth. In addition, a threshold voltage Vth of the transistor M1 is charged in the capacitor Cvth and thus a voltage applied to the gate of the transistor M1 becomes a sum of the data voltage Vdata and the threshold voltage Vth of the transistor M1. The gate-source voltage Vgs of the transistor M1 is given by Equation 3.

$$Vgs=(Vdata+Vth)-VDD \quad \text{[Equation 3]}$$

Further, when the low-level selection signal is applied to the present selection scan line S[1] as shown in FIG. 5, a low-level emission control signal is applied to the emission control line E1[1] and a current $I_{OLED}$ corresponding to the gate-source voltage Vgs of the transistor M1 is applied to the first light emitting element OLED1, and the first light emitting element OLED1 emits light. The current $I_{OELD}$ is given by Equation 4.

$$\begin{aligned} I_{OLED} &= \frac{\beta}{2}(Vgs-Vth)^2 \\ &= \frac{\beta}{2}((Vdata+Vth-VDD)-Vth)^2 \\ &= \frac{\beta}{2}(VDD-Vdata)^2 \end{aligned} \quad \text{[Equation 4]}$$

where $I_{OLED}$ represents a current flowing to the first light emitting element OLED1, Vgs represents the gate-source voltage of the transistor M1, Vth represents the threshold voltage of the transistor M1, Vdata represents a data voltage, and β is a constant number representing the gain of the transistor M1.

During the second field 2F, a voltage $V_{cvth}$ is applied to the capacitor Cvth while a low-level signal is applied to a previous selection scan line S[0] similar to the first field 1F. The transistor M5 is turned on while the low-level selection signal is applied to a present selection scan line S[1], and a data voltage Vdata applied through a data line D[1] is applied to the node B of the capacitor Cvth.

A low-level emission control signal E2[1] is applied to the transistor M22 for a predetermined period of initialization time td, while a low-level selection signal is applied to the previous selection signal S[0]. In other words, the transistor M3 is turned on for the predetermined period of time td and causes the transistor M1 to become diode-connected. At the same time, the low-level emission control signal E2[1] is applied at the gate of the transistor M22 and the transistor M22 is turned on. As the transistors M3 and M22 are turned on, a current initialization path is formed from the gate of the transistor M1, that is the node A of the capacitor Cvth to the cathode VSS of the second light emitting element OLED2 through the transistor M3. The node A of the capacitor Cvth is initialized to VSS-Vth. After the predetermined period of initialization time td has passed, the emission control signal E2[1] becomes high and the transistor M22 is turned off, preventing the current from the transistor M1 from flowing to the second light emitting element OLED2.

During the second field 2F, similar to the first field 1F, the predetermined initialization period td and a light emission period during which the low-level emission control signal is applied to the emission control line E1[1] and the current $I_{OLED}$ is supplied to the second light emitting element OLED2 are separate. Separation of the initialization period td and the light emission period within the second field 2F, helps stable and uniform initialization of the capacitor Cvth.

As the low-level selection signal is applied to the present selection scan line S[1], a low-level emission control signal is applied to an emission control line E2[1] and the transistor M22 is turned on. Thus, a current $I_{OLED}$ corresponding to the gate-source voltage Vgs of the transistor M1 is supplied to the second light emitting element OLED2 causing it to emit light.

Accordingly, the first light emitting element OLED1 in the first row emits light when the emission control signal E1[1] is low and the emission control signal E2[1] is high during the first field 1F. Whereas, the second light emitting element OLED2 emits light when the emission control signal E2[1] is low and the emission control signal E1[1] is high during the second field 2F.

FIGS. 6, 7, 8, 9, 10, 11, 12, 13, and 14 are used to describe the selection and emission scan driver 200 generating the selection signal S[i] and the emission control signals E1[*i*] and E2[*i*] in the embodiments of the organic light emitting display according to the present invention.

Figure 6:
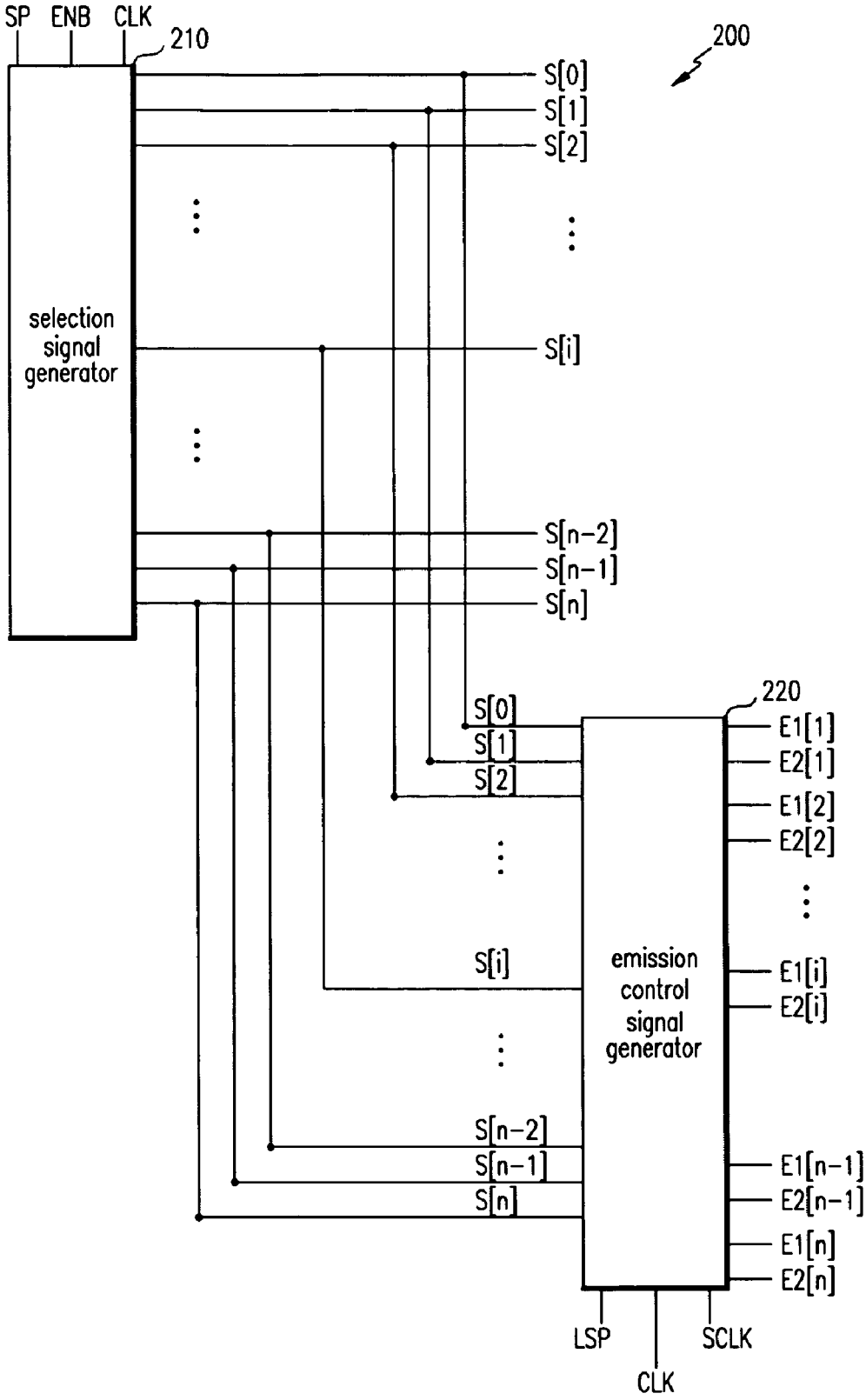
FIG. 6 shows one configuration of a selection and emission control signal driver of a light emitting display according to an embodiment of the present invention.

FIG. 6 illustrates a configuration of the selection and emission control signal driver 200 of the organic light emitting display. The selection signal generator 210 receives a start signal SP, an enable signal ENB, and a clock signal CLK, and generates a selection signal S[i]. The emission control signal generator 220 receives a start signal LSP, clock signals CLK and SCLK, and the selection signal S[i], and generates emission control signals E1[*i*] and E2[*i*].

Figure 7:
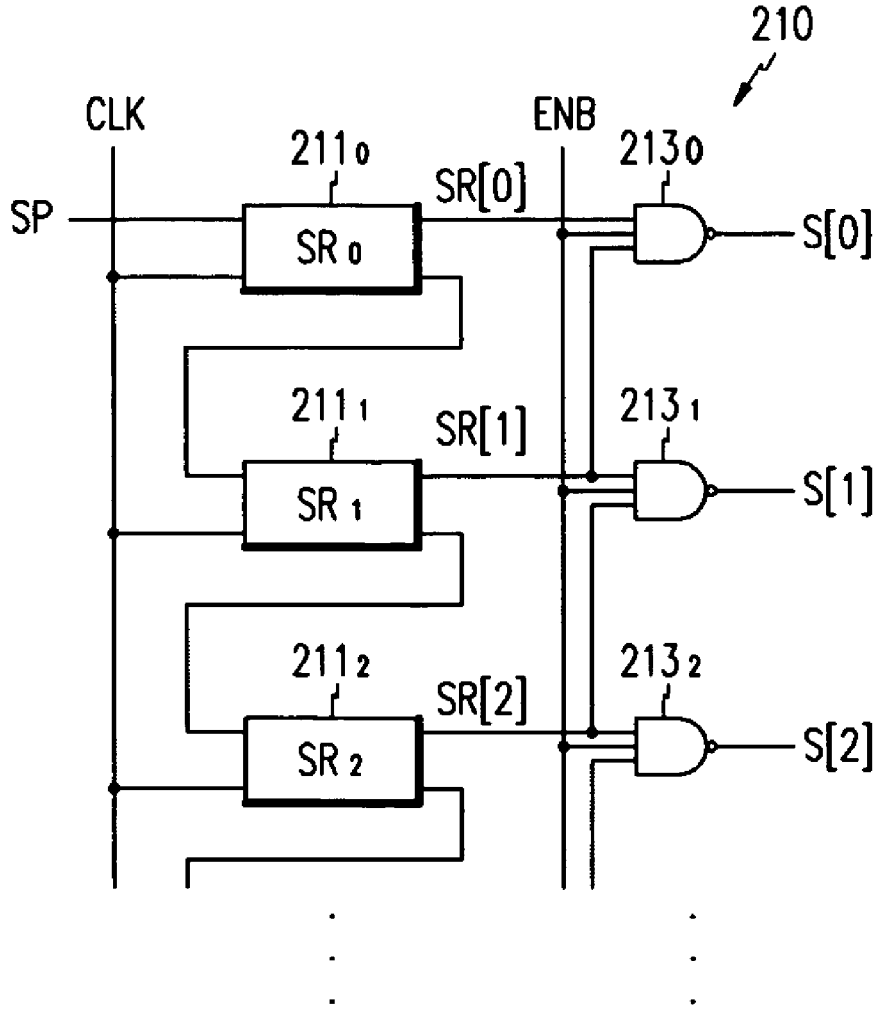
FIG. 7 shows the configuration of the selection signal generator of FIG. 6 in detail.
Figure 8:
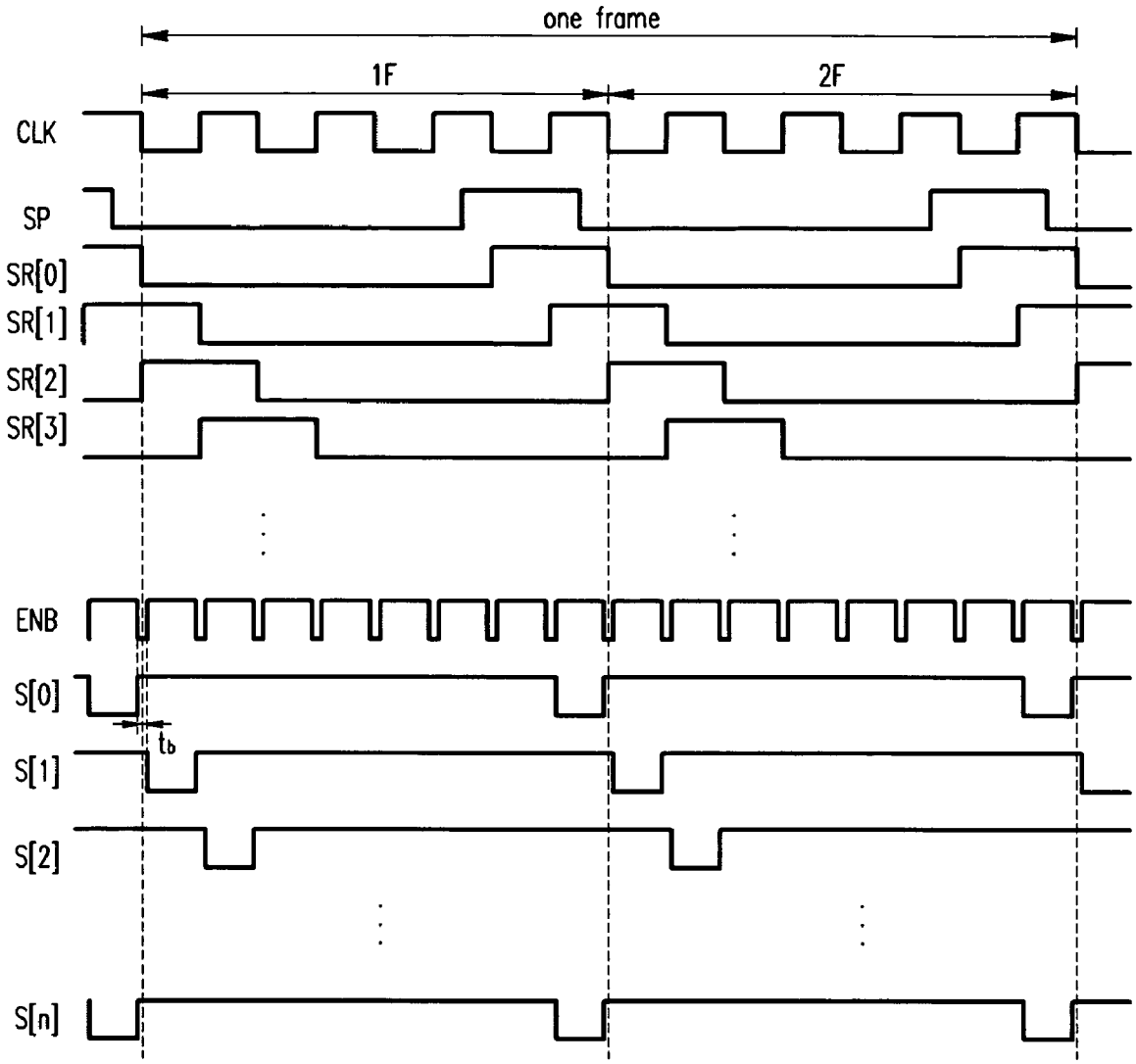
FIG. 8 shows signal timing of outputs from the selection signal generator of FIG. 6.

FIG. 7 depicts a configuration of the selection signal generator 210 in detail, and FIG. 8 shows timing of a signal output from the selection signal generator 210.

The selection signal generator 210 includes a plurality of shift registers $\mathbf{211}_0$ to $\mathbf{211}_n$ and a plurality of NAND gates $\mathbf{213}_0$ to $\mathbf{213}_n$. FIG. 7 exemplarily depicts the shift registers $\mathbf{211}_0$ to $\mathbf{211}_2$ and the NAND gates $\mathbf{213}_0$ to $\mathbf{213}_2$. Further, FIG. 7 only depicts the clock signal CLK, while the clock signal input to the shift registers $\mathbf{211}_0$ to $\mathbf{211}_n$ includes both the clock signal CLK and an inverted signal /CLK of the clock signal CLK.

The shift register $\mathbf{211}_0$ receives the start signal SP and the clock signal CLK. When the clock signal CLK is low, the shift register $\mathbf{211}_0$ outputs and latches the start signal SP. When the clock signal CLK is high, the shift register $\mathbf{211}_0$ outputs the latched start signal SP to generate a signal SR[0]. The shift register $\mathbf{211}_1$ receives the signal SR[0] and the clock signal CLK. When the clock signal CLK is high, the shift register $\mathbf{211}_1$ outputs and latches the signal SR[0]. When the clock signal CLK is low, the shift register $\mathbf{211}_1$ outputs the latched signal SR[0] to generate a signal SR[1]. Consequently, the shift registers $\mathbf{211}_0$ and $\mathbf{211}_1$ respectively generate the signals SR[0] and SR[1] as shown in FIG. 8.

The NAND gate 213*o* receives the signals SR[0] and SR[1] and an enable signal ENB, and generates a low-level selection signal S[0] when the signals SR[0] and SR[1] and the enable signal ENB are high. The NAND gate $\mathbf{213}_1$ receives the signal SR[1], a signal SR[2], and the enable signal ENB, and outputs a signal S[1] becoming low after the selection signal S[0] becomes high and a blanking time tb is passed. Consequently, the respective NAND gates $\mathbf{213}_0$ to $\mathbf{213}_n$ sequentially generate the selection signals S[0] to S[n] respectively, as shown in FIG. 8. Each selection signal S[i] has a predetermined blanking time tb.

Figure 9:
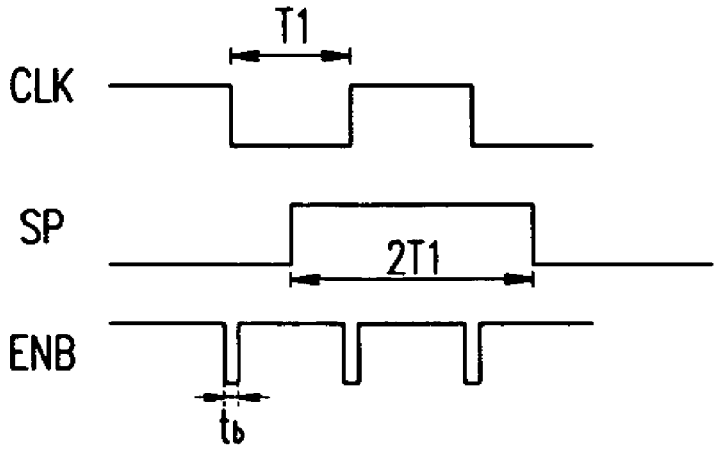
FIG. 9 shows the relationship between a clock signal CLK, a start signal SP, and an enable signal ENB.

FIG. 9 shows a relationship between the clock signal CLK, the start signal SP, and the enable signal ENB input to the selection signal generator 210. A half period of the clock signal CLK input to the selection signal generator 210 is set to be 'T1', and a half period of the start signal SP becomes twice the half period T1 of the clock signal CLK. The enable signal ENB becomes low for a predetermined period of time tb in an edge of a rising period or a falling period of the clock signal CLK.

The emission control signal generator 220 generating emission control signals E1[*i*] and E2[*i*] is described referring to FIGS. 10, 11, 12, 13, and 14.

Figure 10:
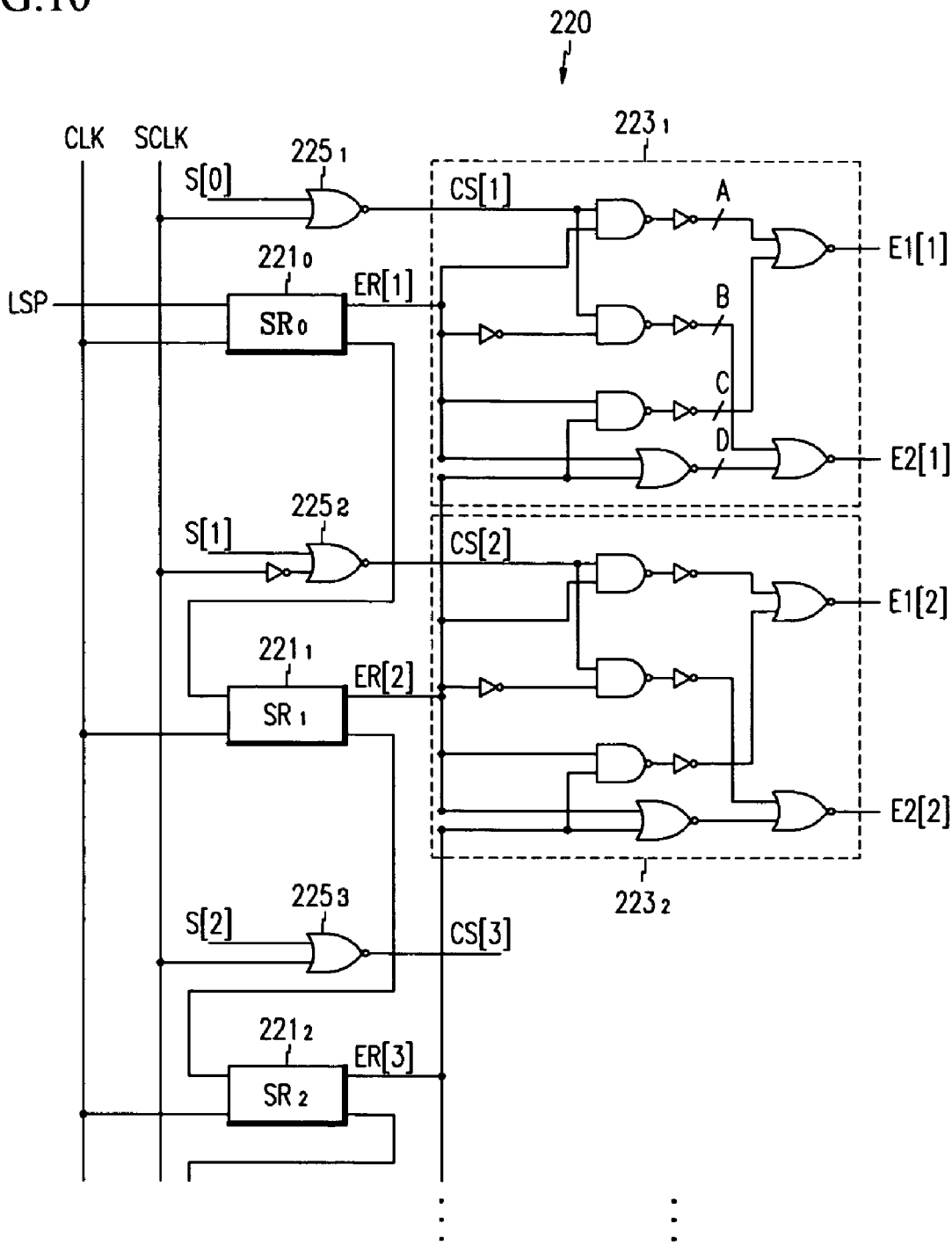
FIG. 10 shows one configuration for an emission control signal generator.

FIG. 10 shows one configuration for the emission control signal generator 220. The emission control signal generator 220 includes a plurality of shift registers $\mathbf{221}_1$ to $\mathbf{221}_n$, a plurality of logic circuits $\mathbf{233}_1$ to $\mathbf{233}_n$, and a plurality of NOR gates $\mathbf{225}_1$ to $\mathbf{225}_n$. To simplify the figure, the shift registers, the logic circuits, and the NOR gates are partially illustrated as $\mathbf{221}_1$ to $\mathbf{221}_3$, $\mathbf{223}_1$ to $\mathbf{223}_2$, and $\mathbf{225}_1$ to $\mathbf{225}_3$. Further, a clock signal input to the shift registers $\mathbf{221}_1$ to $\mathbf{221}_n$ in FIG. 10 includes a clock signal CLK and an inverted clock signal /CLK while only the clock signal CLK is shown.

The shift register $\mathbf{221}_1$ receives a start signal LSP and the clock signal CLK and generates a signal ER[1]. The shift register $\mathbf{221}_2$ receives an output signal of the shift register $\mathbf{221}_1$ and the clock signal CLK and generates a signal ER[2].

The NOR gate $\mathbf{225}_1$ receives a selection signal S[0] output from the selection signal generator 210 and a clock signal SCLK and generates a signal CS[1]. The NOR gate $\mathbf{225}_2$ receives a selection signal S[1] output from the selection signal generator 210 and an inverted clock signal /SCLK and generates a signal CS[2].

The logic circuit $\mathbf{223}_1$ receives the signal ER[1] output from the shift register $\mathbf{221}_1$, the signal ER[2] output from the shift register $\mathbf{221}_2$, and the signal CS[1] output from the NOR gate $\mathbf{225}_1$ and generates emission control signals E1[1] and E2[1]. The logic circuit $\mathbf{223}_2$ receives the signal ER[2] output from the shift register $\mathbf{221}_2$, a signal ER[3] output from the shift register $\mathbf{221}_3$, and the signal CS[2] output from the NOR gate $\mathbf{225}_2$ and outputs emission control signals E1[2] and E2[2].

Figure 11:
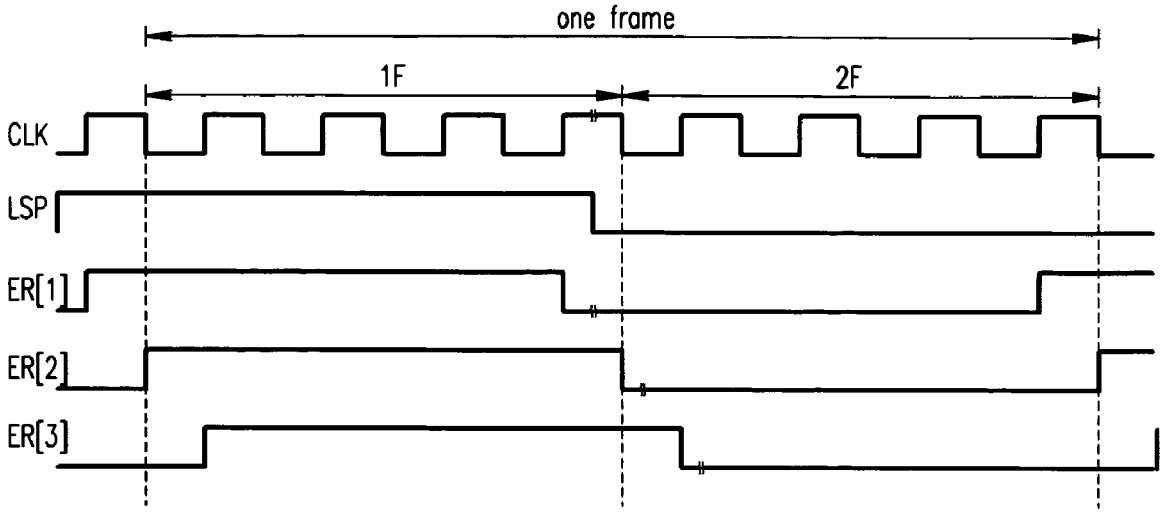
FIG. 11 shows signal timing of waveforms of input and output signals of shift registers.

FIG. 11 which shows timing of the input and output signals of the shift registers $\mathbf{221}_1$ to $\mathbf{221}_3$ is used to describe the input and output signals of the shift registers $\mathbf{221}_1$ to $\mathbf{221}_3$.

The shift register $\mathbf{221}_0$ receives the start signal LSP and the clock signal CLK and outputs the start signal LSP, and maintains the start signal LSP during a first field 1F and generates the signal ER[1]. The shift register $\mathbf{221}_1$ receives the output signal of the shift register $\mathbf{221}_0$ and the clock signal CLK and outputs a high-level signal ER[1] when the clock signal CLK is high, and maintains the high-level signal ER[1] for the first field and generates the signal ER[2]. In a like manner, sequentially shifting ER[i] signals are generated.

Figure 12:
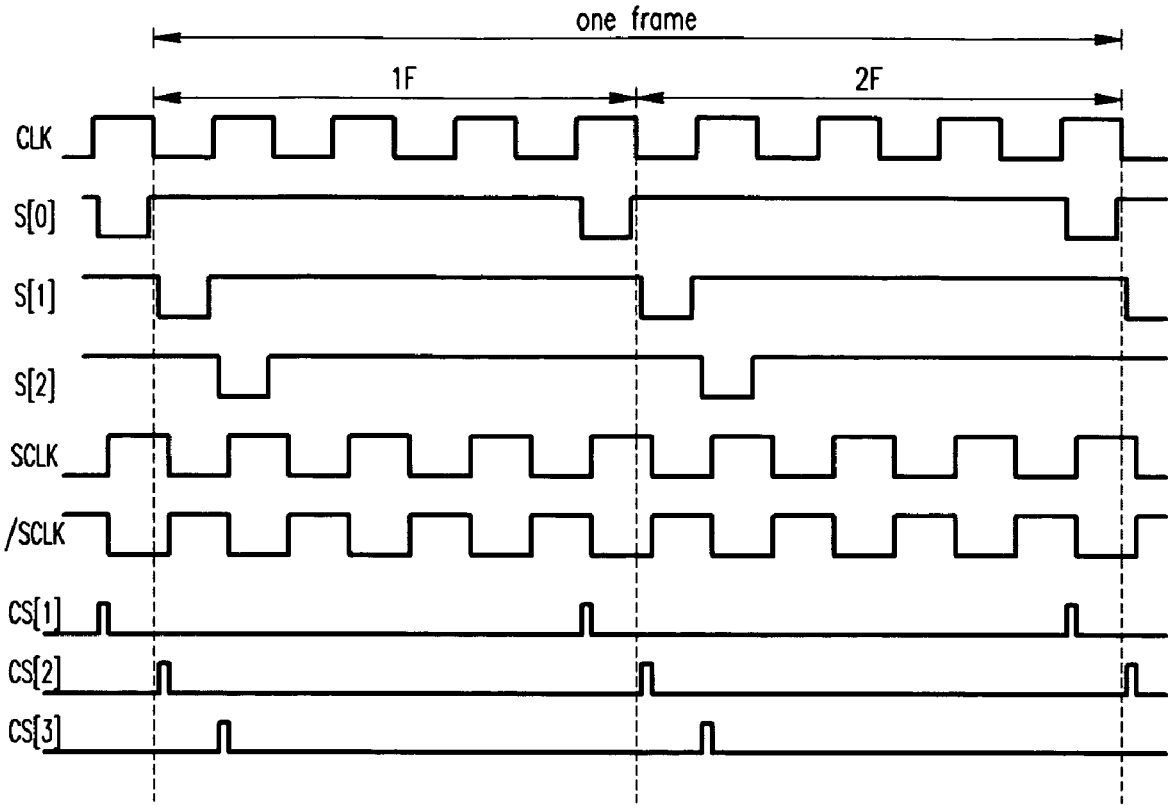
FIG. 12 shows signal timing of waveforms of input and output signals of NOR gates.

FIG. 12 shows signal timing depicting waveforms of the input and output signals of the NOR gates $\mathbf{225}_1$ to $\mathbf{225}_3$. With reference to this figure, input and output signals of the NOR gates $\mathbf{225}_1$ to $\mathbf{225}_3$ are described in detail.

The NOR gate $\mathbf{225}_1$ receives the selection signal S[0] output from the selection signal generator 210 and the clock signal SCLK which is delayed by ¼T a quarter of the half period of the clock signal CLK, and generates a high-level signal CS[1] when the selection signal S[0] and the clock signal SCLK are both low. The NOR gate $\mathbf{225}_2$ receives the selection signal S[1] output from the selection signal generator 210 and the inverted clock signal /SCLK and generates a high-level signal CS[2] when the selection signal S[1] and the inverted clock signal /SCLK are both low. In a like manner, sequentially shifting signals CS[i] are generated.

Figure 13:
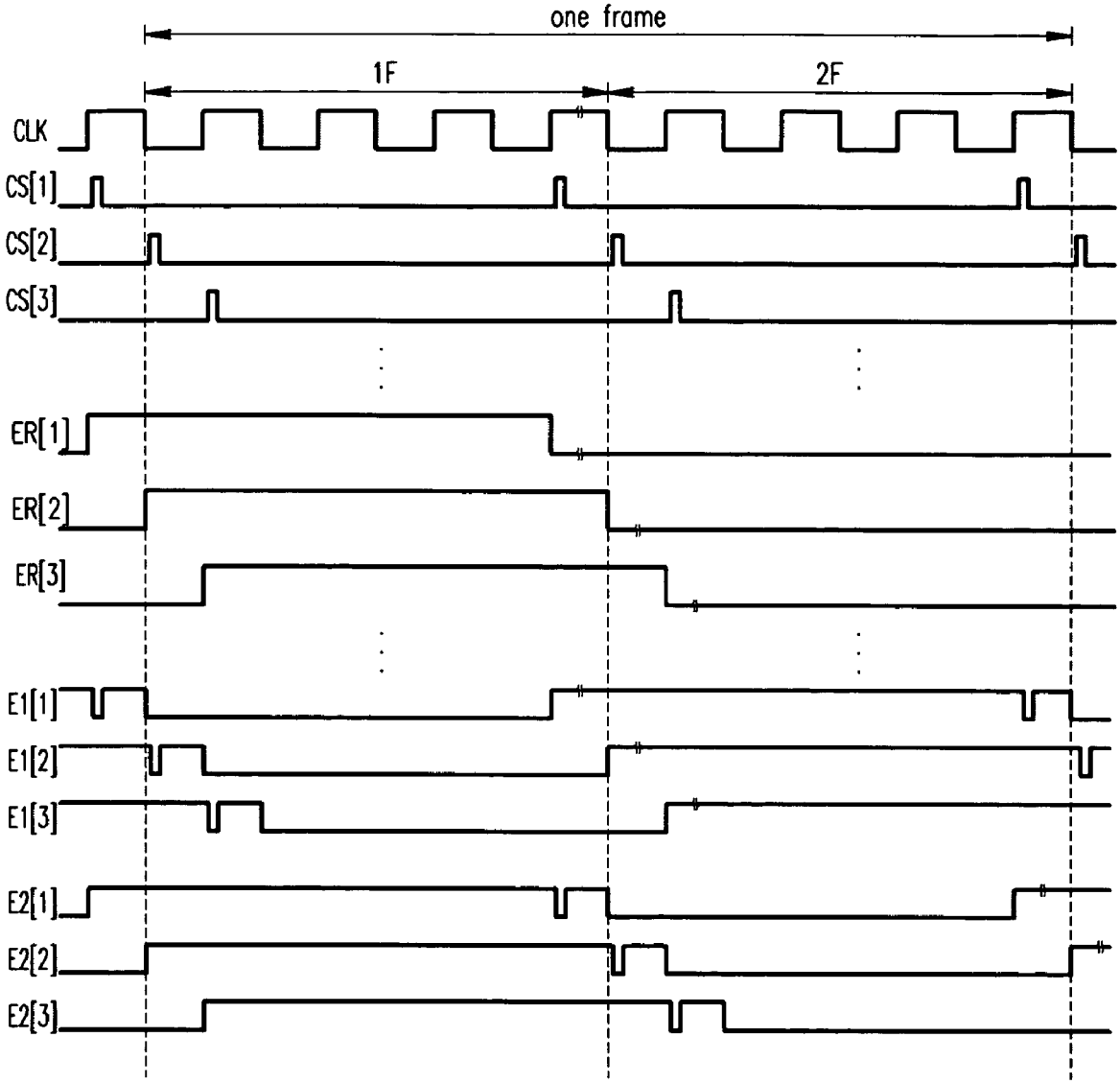
FIG. 13 shows signal timing of waveforms of input and output signals of logic circuits.

FIG. 13 shows signal timing illustrating waveforms of the input and output signals of the logic circuits $\mathbf{223}_1$ to $\mathbf{233}_3$. Referring to this figure, an input signal and an output signal of the logic circuits $\mathbf{223}_1$ to $\mathbf{233}_3$ are described in detail.

The logic circuit $223_1$ receives the signal ER[1] output from the shift register $221_0$, the signal ER[2] output from the shift register $221_1$, and the signal CS[1] output from the NOR gate $225_1$ and outputs the emission control signals E1[1] and E2[1]. The logic circuit $223_2$ receives the signal ER[2] output from the shift register $221_1$, the signal ER[3] output from the shift register $221_2$, and the signal CS[2] output from the NOR gate $225_2$ and outputs the emission control signals E1[2] and E2[2].

Figure 14:
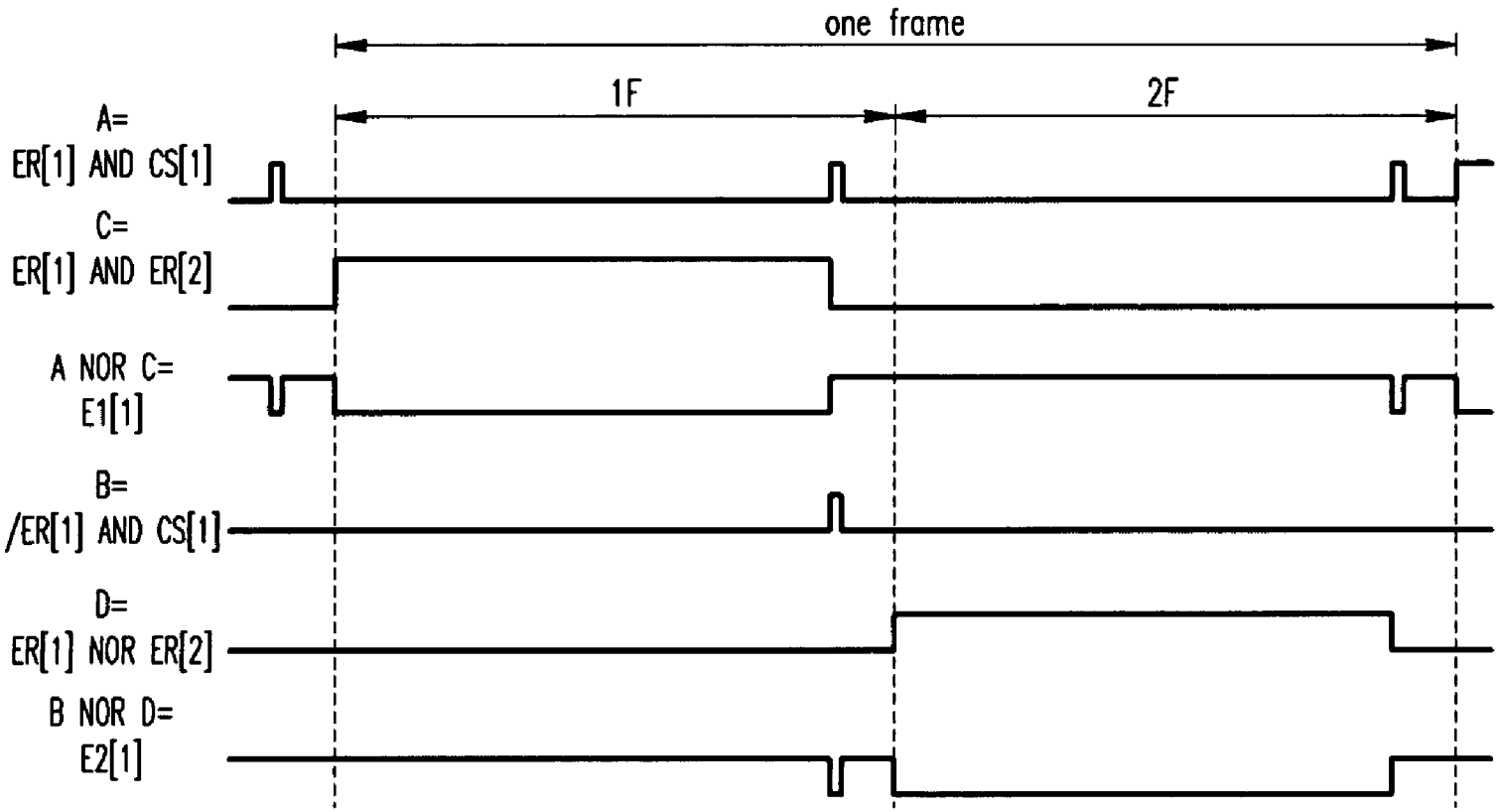
FIG. 14 shows the process of generating emission control signals through the logic circuit based on the signal timing shown in FIG. 13.

Referring to FIG. 14, a process of generating the emission control signals E1[1] and E2[1] through the logic circuit $223_1$ is described. The logic circuit $223_1$ may include three NAND gates, three NOR gates, and four inverters, but it is not restricted to this configuration. The logic circuit $223_1$ may be implemented by AND gates which are equivalent to a combination of NAND gates and inverters or any other equivalent circuit.

An emission control signal E1[1] is generated as follows. A signal A in the logic circuit $223_1$ is generated by a logical operation AND on the output signal CS[1] of the NOR gate $225_1$ and the output signal ER[1] of the shift register $221_0$. In other words, the signal A becomes high when the signal CS[1] and the signal ER[1] are both high as shown in FIG. 13. Further, a signal C is generated by the logical operation AND on the output signal ER[1] of the shift register $221_0$ and the output signal ER[2] of the shift register $221_1$. In other words, the signal C becomes high when the signals ER[1] and ER[2] are both high as shown in FIG. 13. By way of performing a NOR operation on the signals A and C, the emission control signal E1[1] is generated as shown in FIG. 14.

An emission control signal E2[1] is generated as follows. A signal B in the logic circuit $223_1$ is generated by the logical operation AND on the output signal CS[1] of the NOR gate $225_1$ and an inverted signal /ER[1] of the signal ER[1] output from the shift register $221_0$. Accordingly, the signal B becomes high when the signal CS[1] and the inverted signal /ER[1] are both high as shown in FIG. 13. Further, a signal D is generated by a logical operation NOR on the output signal ER[1] of the shift register $221_0$ and the output signal ER[2] of the shift register $221_1$. Accordingly, the signal D becomes high when the signals ER[1] and ER[2] are both low as shown in FIG. 13. By way of the NOR operation on the signals B and D, the emission control signal E2[1] is generated as shown in FIG. 14.

As described above, two emission control signals may be generated according to the foregoing embodiments of the present invention. The two emission control signals include an initialization time td for stably initializing a capacitor using one shift register alone. Thus, by reducing the total number of required shift registers, drivers of selection control signals and emission control signals may be more easily implemented. Also, by reducing the total number of transistors used for the selection and emission control signal drivers, both the circuit area and errors caused by the transistors may be reduced, thereby increasing yield.

The embodiments of the present invention, that are shown in the figures, include a pixel circuit having two light emitting elements, five transistors, and two capacitors, but the invention is not restricted to the embodiments shown. The present invention may be applied to a pixel circuit including a driving transistor producing a current applied to the light emitting elements and an emission scan transistor coupled between the driving transistor and the light emitting elements. Further, the present invention may be applied to an apparatus generating two signals based on a signal generated from a shift register.

According to the present invention, an initialization period is provided that is separate from an emission period during which a current $I_{OLED}$ is supplied to an OLED. During this period a low-level emission control signal is applied to an emission control line that stably and uniformly initializes a capacitor. The deviation of the current $I_{OLED}$ occurs due to deviation of a voltage Vgs of a driving transistor in each pixel when the initialization of the capacitor varies with pixels. Based on the above feature of the invention, deviation of the current $I_{OLED}$ output from the driving transistor may be prevented.

In addition, according to the present invention, two emission control signals including a time td stably initialize a capacitor using one shift register. Thus, the total number of shift registers is reduced, thereby implementing a selection signal generator and an emission control signal generator with ease. Further, a circuit area may be reduced by way of reducing a total number of transistors for the selection and emission control signal driver and errors caused by the transistors may be also reduced, therefore increasing yield.

While this invention has been described in connection with exemplary embodiments, it is understood that the invention is not limited to the disclosed embodiments. Rather, it is intended to cover various modifications and equivalent arrangements included within the spirit and scope of the appended claims.

What is claimed is:

1. A light emitting display comprising:

a display area including a plurality of data lines for transmitting data signals for displaying an image, a plurality of selection scan lines for transmitting selection signals and a plurality of first and second emission control lines for respectively transmitting first and second emission control signals over a frame, and a plurality of pixels coupled by the data lines and the selection scan lines and having first and second light emitting elements;

a selection signal generator for sequentially generating selection signals having a selection pulse through sequentially shifting the selection signals by a first length of time during each of a first field and a second field, the first field and the second field together forming the frame; and an emission control signal generator for:

generating a first control signal from the selection pulse of the selection signal during each of the first and second fields, the first control signal having a control pulse, the control pulse being smaller than the selection pulse, sequentially generating a first emission control signal having an emission control pulse corresponding to the control pulse and a shifted first emission control pulse following the emission control pulse during the first field, the shifted first emission control pulse obtained through shifting the first emission control signal by the first length of time, and sequentially generating a second emission control signal having the emission control pulse and a shifted second emission control pulse following the emission control pulse during the second field, the shifted second emission control pulse obtained through shifting the second emission control signal by the first length of time.

2. The light emitting display according to claim 1, wherein a data signal corresponding to the first light emitting element is transmitted to the data lines while the selection pulse is being applied during the first field, and a data signal corresponding to the second light emitting element is transmitted to the data lines while the selection pulse is being applied during the second field.

3. The light emitting display according to claim 1, wherein the selection signal generator comprises:

a first shift register for sequentially generating a first shift register signal having a first shift register pulse by sequentially shifting the first shift register signal by the first length of time to generates a shifted first shift register signal; and a first circuit for generating the selection signal, the first circuit coupled to the first shift register and receiving the first shift register signal as an input, wherein the first shift register pulse has a first shift register pulse width and a first shift register pulse period, and wherein the first shift register signal and the shifted first shift register signal occur within the first shift register pulse period.

4. The light emitting display according to claim 3, wherein the first circuit is configured to receive an enable signal, and to output the selection signal, the first shift register signal, the shifted first shift register signal, and the enable signal during the first shift register pulse period.

5. The light emitting display according to claim 1, wherein the emission control signal generator comprises:

a second shift register for sequentially generating a second shift register signal alternately having a second shift register pulse and an inverted second shift register pulse by sequentially shifting the second shift register signal by the first length of time and generating a shifted second shift register signal;

a second circuit for generating the first control signal by partially cutting the selection pulse; and a logic circuit for generating the first and second emission control signals, in response to the first control signal, the second shift register signal, and the shifted second shift register signal, the logic circuit coupled with the second shift register and the second circuit.

6. The light emitting display according to claim 5, wherein the second circuit is configured to output the control pulse while a first clock signal and the selection signal both have a level corresponding to the selection pulse, the first clock signal having a period twice as long as the first length of time.

7. The light emitting display according to claim 6, wherein the first clock signal results from a second clock signal input to the second shift register and shifted by a predetermined length of time.

8. The light emitting display according to claim 5, wherein the logic circuit is configured to:

output the shifted first emission control pulse for a period in which the second shift register signal and the shifted second shift register signal have the second shift register pulse, generate the first emission control signal from the shifted emission control pulse and the control pulse of the first field, output the shifted second emission control pulse for a period in which the second shift register signal and the shifted second shift register signal have the inverted second shift register pulse, and generate the second emission control signal from the shifted second emission control pulse and the emission control pulse of the second field.

9. The light emitting display according to claim 1, wherein the period in which the second shift register pulse is applied corresponds to the first field.

10. The light emitting display according to claim 1, wherein the emission control pulses of the first and second emission control signals are applied while the selection pulse is being applied, the selection pulse corresponding to the selection signal before the selection signal is shifted.

11. The light emitting display according to claim 1, wherein each of the plurality of pixels comprises:

a first transistor turned on in response to a first level of a first selection signal for transmitting the data signal;

a first capacitor for storing a voltage corresponding to the data signal transmitted by the first transistor;

a second transistor coupled in parallel with the first capacitor, the second transistor turned on in response to a first level of a second selection signal;

a third transistor for generating a current corresponding to the voltage stored in the first capacitor;

a second capacitor for storing a voltage corresponding to a threshold voltage of the third transistor;

a fourth transistor for diode-connecting the third transistor in response to the first level of the second selection signal;

a first light emitting element and a second light emitting element for emitting light of first and second colors in response to the current; and a first switch and a second switch respectively turned on in response to first levels of the first and second emission control signals for selectively transmitting the current to the first light emitting element and the second light emitting element.

12. A driving method of a light emitting display comprising a plurality of pixels each driven by a data signal, a first selection signal, a second selection signal, and a control signal, the driving method comprising:

applying the first selection signal having a selection pulse of a first level;

applying the control signal having a control pulse of the first level during a portion of the applying the first selection signal having the selection pulse of the first level and an emission control pulse of the first level while the first selection signal is in an inverted first level; and applying the second selection signal having a selection pulse of the first level while the first selection signal is in the inverted first level, wherein during the applying the second selection signal having the selection pulse of the first level to a pixel of the plurality of pixels, the data signal is transmitted to the pixel.

13. The driving method according to claim 12, wherein each of the plurality of pixels comprises:

a first transistor turned on in response to the first level of the second selection signal for transmitting the data signal;

a first capacitor storing a voltage corresponding to the data signal transmitted by the first transistor;

a second transistor coupled in parallel with the first capacitor, the second transistor turned on in response to the first level of the first selection signal;

a third transistor generating a current corresponding to the voltage stored in the first capacitor;

a second capacitor storing a voltage corresponding to a threshold voltage of the third transistor;

a fourth transistor diode-connecting the third transistor in response to the first level of the first selection signal;

a first light emitting element and a second light emitting element emitting light of first and second colors in response to the current; and a first switch and a second switch respectively turned on in response to first levels of first and second emission control signals for selectively transmitting the current to the first and second light emitting elements.

14. The driving method according to claim 13, wherein during the applying the first selection signal having the selection pulse of the first level, the second and fourth transistors are turned on in response to the first level of the first selection signal.

15. The driving method according to claim 13, wherein during the applying the control signal having the control pulse of the first level, one of the first and second switches is turned on in response to the first level of the control signal.

16. A signal driving apparatus for generating a sequentially shifted signal and outputting the signal, the apparatus comprising:

a first shift register for receiving a first clock signal and a first start signal, and for sequentially generating a first signal having a first pulse of a first level in response to the first clock signal and the first start signal while shifting the first signal by a first length of time;

a first circuit for receiving the first signal and a signal which is the first signal shifted by the first length of time, and for sequentially generating a selection signal having a second pulse of a second level in response to the first signal and the signal which is the first signal shifted by the first length of time;

a second shift register for receiving the first clock signal and a second clock signal, and for sequentially generating a second signal having a third pulse of the first level in response to the first clock signal and the second clock signal while shifting the second signal by the first length of time;

a second circuit for receiving the selection signal and the second clock signal, and for generating a third signal having a fourth pulse at the first level in response to the selection signal and the second clock signal; and a third circuit for receiving the second signal, a signal which is the second signal shifted by the first length of time, and the third signal, and for generating a first control signal in response to the second signal, the signal which is the second signal shifted by the first length of time, and the third signal.

17. The signal driving apparatus according to claim 16, wherein the first circuit is configured to generate the selection signal having the second pulse of the second level while the first signal and the signal which is the first signal shifted by the first length of time are both at the first level.

18. The signal driving apparatus according to claim 16, wherein the second clock signal corresponds to the first clock signal shifted by a predetermined time period, and wherein the second circuit is configured to generate the third signal having the fourth pulse while the selection signal and the second clock signal are at the second level.

19. The signal driving apparatus according to claim 16, wherein the third circuit is configured to:

generate a fourth signal having the first level while the second signal and the third signal are also both at the first level, generate a fifth signal having the first level while the second signal and a signal which is the second signal shifted by the first length of time are also both at the first level, and generate a first control signal having the first level while the fourth and fifth signals are at the second level.

20. The signal driving apparatus according to claim 16, further comprising a fourth circuit for generating a second control signal in response to the second signal, an inverted second signal, a signal which is the second signal shifted by the first length of time, and the third signal.

21. The signal driving apparatus according to claim 20, wherein the fourth circuit is configured to:

generate a sixth signal having the first level while the inverted second signal and the third signal are at the first level, generate a seventh signal having the first level while the second signal and the signal which is the second signal shifted by the first length of time are both at the second level, and generate the second control signal having the first level while the sixth signal and the seventh signal are both at the second level.

22. The signal driving apparatus according to claim 16, wherein the first level is a high level and the second level is a low level.

23. A driving method of a light emitting display comprising a plurality of pixels driven by a first selection signal, a second selection signal, a first emission control signal, and a second emission control signal, the driving method comprising:

applying the first selection signal having a first pulse of a second level, followed by a second pulse of a first level, followed by a third pulse of the second level, and repeating;

applying the second selection signal having a waveform similar to the first selection signal and lagging behind the first selection signal by a blanking period; and applying the first emission control signal or the second emission control signal each capable of having an initialization pulse at the first level while the first selection signal is at the first level and the second selection signal is at the second level, the initialization pulse followed by a fourth pulse at the second level while the first selection signal goes from the first level to the second level and the second selection signal goes from the second level to the first level;

wherein each of the pixels of the plurality of pixels includes:

a first transistor turned on in response to the first level of the second selection signal for transmitting a data signal;

a first capacitor storing a voltage corresponding to the data signal transmitted by the first transistor;

a second transistor coupled in parallel with the first capacitor and being turned on in response to the first level of the first selection signal;

a third transistor generating a current corresponding to the voltage stored in the first capacitor;

a second capacitor storing a voltage corresponding to a threshold voltage of the third transistor;

a fourth transistor diode-connecting the third transistor in response to the first level of the first selection signal;

a first light emitting element and a second light emitting element emitting light of first and second colors in response to the current; and a first switch and a second switch respectively turned on in response to the first levels of the first emission control signal and the second emission control signal for selectively transmitting the current to the first light emitting element and the second light emitting element.

* * * * *

UNITED STATES PATENT AND TRADEMARK OFFICE

CERTIFICATE OF CORRECTION

PATENT NO. : 7,777,701 B2
APPLICATION NO. : 11/210502
DATED : August 17, 2010
INVENTOR(S) : Ki-Myeong Eom It is certified that error appears in the above-identified patent and that said Letters Patent is hereby corrected as shown below:

| **PATENT** | **ERROR** |
|---|---|
| **In the Claims** | |
| Column 15, Claim 3, line 6 | Delete "generates"<br>Insert -- generate -- |

Signed and Sealed this
Third Day of April, 2012

David J. Kappos

David J. Kappos
*Director of the United States Patent and Trademark Office*